US010301975B2

(12) United States Patent
Kuhn et al.

(10) Patent No.: US 10,301,975 B2
(45) Date of Patent: May 28, 2019

(54) OVERLOAD INTRODUCTION INTO A STEAM TURBINE

(71) Applicant: Siemens Aktiengesellschaft, Munich (DE)

(72) Inventors: Martin Kuhn, Neuss (DE); Ralf Plaumann, Gelsenkirchen (DE); Dominic Schlehuber, Oberhausen (DE); Aleksandar Stanisic, Mülheim an der Ruhr (DE)

(73) Assignee: Siemens Aktiengesellschaft, Munich (DE)

( * ) Notice: Subject to any disclaimer, the term of this patent is extended or adjusted under 35 U.S.C. 154(b) by 0 days.

(21) Appl. No.: 15/748,801

(22) PCT Filed: Jun. 30, 2016

(86) PCT No.: PCT/EP2016/065290
§ 371 (c)(1),
(2) Date: Jan. 30, 2018

(87) PCT Pub. No.: WO2017/025242
PCT Pub. Date: Feb. 16, 2017

(65) Prior Publication Data

US 2019/0010831 A1 Jan. 10, 2019

(30) Foreign Application Priority Data

Aug. 7, 2015 (EP) ..... 15180187

(51) Int. Cl.
*F01K 7/18* (2006.01)
*F01K 7/20* (2006.01)
(Continued)

(52) U.S. Cl.
CPC ..... *F01K 7/18* (2013.01); *F01D 17/105* (2013.01); *F01D 17/145* (2013.01); *F01D 17/18* (2013.01);
(Continued)

(58) Field of Classification Search
CPC ..... F01D 17/145; F01D 17/18; F01D 17/105; F01D 25/24; F01D 25/26; F01K 7/18;
(Continued)

(56) References Cited

U.S. PATENT DOCUMENTS 4,118,935 A * 10/1978 Andersson ..... F01K 7/20 290/40 R
4,403,476 A * 9/1983 Johnson ..... F01D 17/105 60/652
(Continued)

FOREIGN PATENT DOCUMENTS

CH 211167 A 8/1940
EP 2299068 A1 3/2011
(Continued)

OTHER PUBLICATIONS

EP Search Report dated Jan. 8, 2016, for EP patent application No. 15180187.5.
(Continued)

*Primary Examiner* — Mark A Laurenzi
*Assistant Examiner* — Xiaoting Hu
(74) *Attorney, Agent, or Firm* — Beusse Wolter Sanks & Maire

(57) ABSTRACT

An assembly with a steam turbine and an overload valve, wherein the overload valve is arranged opposite the fresh steam valve and a fresh steam flows partially through the flow channel and partially into an overload inflow region via the overload valve.

7 Claims, 2 Drawing Sheets

(51) Int. Cl.

| | |
|---|---|
| ***F01D 17/10*** | (2006.01) |
| ***F01D 17/14*** | (2006.01) |
| ***F01D 17/18*** | (2006.01) |
| ***F01D 25/26*** | (2006.01) |
| ***F01K 13/02*** | (2006.01) |

(52) U.S. Cl.
CPC ..... *F01D 25/26* (2013.01); *F01K 7/20* (2013.01); *F01K 13/02* (2013.01); *F05D 2220/31* (2013.01); *F05D 2270/3061* (2013.01)

(58) Field of Classification Search
CPC .... F01K 7/20; F01K 13/02; F05D 2270/3061; F05D 2220/31
See application file for complete search history.

(56) References Cited

U.S. PATENT DOCUMENTS

| | | | | |
|---|---|---|---|---|
| 8,505,299 | B2 * | 8/2013 | Mundra | F01D 17/18 415/116 |
| 8,863,522 | B2 * | 10/2014 | Cornell | F01K 7/22 60/663 |
| 2008/0213085 | A1 * | 9/2008 | Deidewig | F01D 3/04 415/104 |
| 2012/0174584 | A1 * | 7/2012 | Bennauer | F01K 7/22 60/657 |
| 2013/0312410 | A1 * | 11/2013 | Herzog | F01K 7/08 60/641.8 |
| 2014/0130499 | A1 * | 5/2014 | Graeber | F01K 7/40 60/652 |
| 2014/0328673 | A1 * | 11/2014 | Tamaoki | F01D 17/18 415/149.1 |
| 2015/0125266 | A1 * | 5/2015 | Takahashi | F01D 1/023 415/116 |
| 2016/0194982 | A1 * | 7/2016 | Jourdain | F01D 25/32 60/648 |
| 2018/0191234 | A1 | 7/2018 | Guina et al. | |

FOREIGN PATENT DOCUMENTS

| | | | |
|---|---|---|---|
| EP | 2546476 | A1 | 1/2013 |
| JP | S63167001 | A | 7/1988 |
| JP | S63134105 | U | 9/1988 |
| JP | 2000509457 | A | 7/2000 |
| JP | 2006161698 | A | 6/2006 |
| RU | 2608386 | C2 | 1/2017 |
| WO | 9741335 | A1 | 11/1997 |

OTHER PUBLICATIONS

International Search Report dated Sep. 23, 2017, for PCT/EP2016/065290.
Russian Search Report from RU Office Action dated Sep. 6, 2018 for corresponding RU Application No. 2018107270.

* cited by examiner

OVERLOAD INTRODUCTION INTO A STEAM TURBINE

CROSS REFERENCE TO RELATED APPLICATIONS

This application is the US National Stage of International Application No. PCT/EP2016/065290 filed Jun. 30, 2016, and claims the benefit thereof. The International Application claims the benefit of European Application No. EP15180187 filed Aug. 7, 2015. All of the applications are incorporated by reference herein in their entirety.

FIELD OF INVENTION

The invention relates to an assembly comprising a steam turbine with a two-shell casing which comprises an outer casing and an inner casing arranged therein, and a connection guided through the outer casing, wherein the connection is designed with a pair of connection openings formed by a first connection opening and a second connection opening which are formed on the inner casing, further comprising a first valve for feeding steam into the inner casing, wherein the first valve is fluidically connected to the first connection opening.

BACKGROUND OF INVENTION

Steam turbines are used for generating electrical energy. In normal operation, a steam is generated in the steam generator and channeled to the steam turbine to an inflow region. In the steam turbine, the thermal energy of the steam is converted into mechanical rotational energy of the rotor. However, operating states are possible where more power is required of the steam turbine, this being ensured by using an additional firing system in the steam generator that leads to an increase in the steam mass flow. This increase in the steam mass flow is fed into the steam turbine in a known manner via overload inflow regions situated downstream in the blading region. For this purpose, a branching of the fresh-steam line is established which is fluidically connected downstream to the overload inflow region.

In this overload line there is arranged an overload valve which is closed in the normal situation. A quick-closing valve and a control valve are arranged in the fresh-steam line. In some embodiments, the overload valve is arranged below the steam turbine, resulting in unnecessary additional pipeline connections. In addition, the overload valve and the pipelines have to be held, which constitutes additional outlay. The overload valve is positioned below the center of the turbine, with the result that the drainage of the overload valve becomes an absolute low point and thus makes a drainage station absolutely necessary.

SUMMARY OF INVENTION

It is an object of the invention to specify a more cost-effective assembly and a method for overload operation.

This is achieved by an assembly and a method as claimed.

Advantageous developments are indicated in the sub-claims.

The invention starts from the aspect that it is possible to avoid a complicated piping of the second valve, which can be designated as an overload valve. Likewise, it is possible to dispense with an additional drainage station. The first valve and the second valve are arranged comparatively at a small distance from one another on the steam turbine.

In a first aspect of the invention, the steam turbine further has an overload inflow region which is fluidically connected to the second valve.

In a second aspect of the invention, the steam turbine has a blading region which is configured for a flow direction, wherein the overload inflow region opens into the blading region after a blade stage situated downstream in the flow direction.

In a further aspect of the invention, the connection openings are formed oppositely on the inner casing.

The above-described properties, features and advantages of this invention and also the way in which they are achieved will become more clearly and readily comprehensible in conjunction with the following description of the exemplary embodiments, which will be explained in more detail in connection with the drawings.

Exemplary embodiments of the invention will be described hereinbelow with reference to the drawings. These drawings are not intended to illustrate the exemplary embodiments true to scale; rather, the drawings, where used for explanatory purposes, are schematic and/or slightly distorted. With regard to additions to the teaching which is directly apparent in the drawing, reference is made to the relevant prior art.

DETAILED DESCRIPTION OF INVENTION

Figure 1:
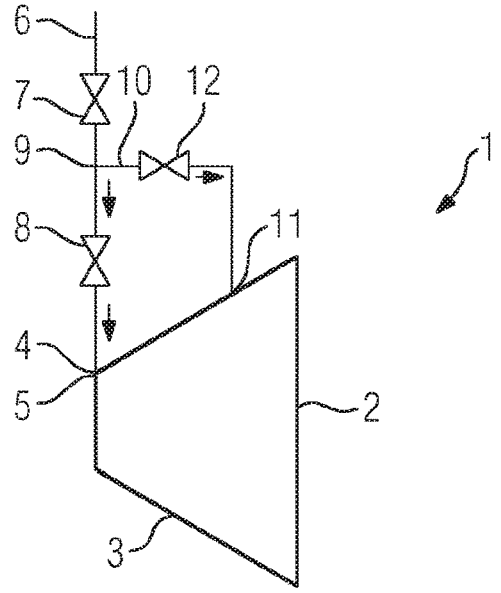
FIG. 1 shows an assembly with a steam turbine and an overload inflow region according to the prior art.

FIG. 1 shows an assembly 1 according to the prior art. The assembly 1 comprises a steam turbine 2 with a two-shell casing (not shown) which comprises an outer casing 3 and an inner casing (not shown) arranged therein. Furthermore, the steam turbine 2 comprises a connection 4 guided through the outer casing 3. The steam turbine 2 comprises a rotatably mounted rotor and an inflow region 5 for a fresh steam. The inflow region 5 is fluidically connected to a fresh-steam line 9. In this fresh-steam line 9 there are arranged a quick-closing valve 7 and a control valve 8. Furthermore, the arrangement 1 comprises a branching 9. At this branching 9 there is arranged an overload line 10 which opens into an overload inflow region 11 in the steam turbine 2. In the overload line 10 there is arranged an overload valve 12 which is arranged in the actual structure below the steam turbine 2, which leads to disadvantages.

In normal operation, a fresh steam flows via the fresh-steam line 6 and the quick-closing valve 7 and control valve 8 into the inflow region 5 of the steam turbine. The thermal energy of the steam is converted into mechanical energy of the rotor. The rotation of the rotor can finally be converted into electrical energy by means of a generator. In an overload operation, that is to say when the steam generator generates more steam flow than in normal operation, the overload valve 12 is open and some of the steam is caused to flow via the overload line into the overload inflow region 11. In normal operation, the overload valve 12 is closed. Opening the overload valve 12 makes it possible to increase the power of the steam turbine 2.

Figure 2:
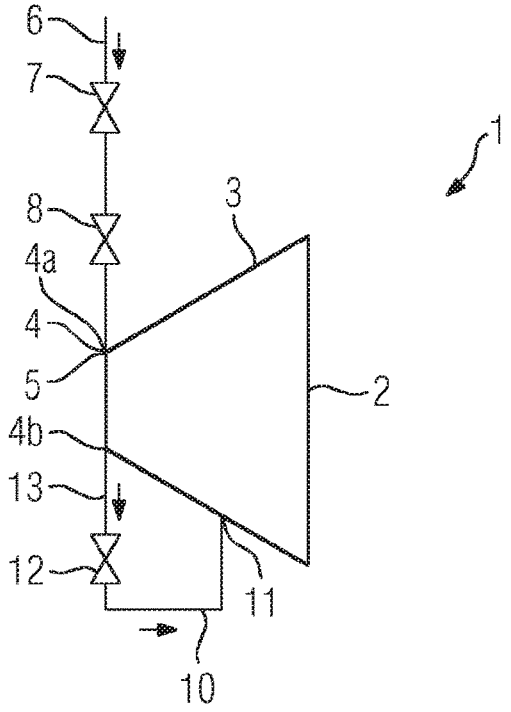
FIG. 2 shows an assembly according to the invention with an overload device.

FIG. 2 shows an assembly 1 according to the invention. The fresh-steam line 6 is fluidically connected to the inflow region 5 via the quick-closing valve 7 and control valve 8. The connection 4 is designed with a pair of connection openings 4*a*, 4*b* formed by a first connection opening 4*a* and a second connection opening 4*b* which are formed on the inner casing. Furthermore, the assembly 1 comprises a second valve 12, which can be designated as an overload valve and is designed for discharging steam. This takes place via a discharge line 13 and opens into an overload line 10 into the overload inflow region 11. Thus, in the case of this assembly 1 according to the invention, the inflowing steam in an overload situation is channeled via the fresh-steam line 6 into the quick-closing valve 7 and then into the control valve 8 and flows via the inflow region 5 partially into a flow duct and partially out of the steam turbine 2 again via the discharge line 13. The steam channeled out of the steam turbine 2 flows via the overload valve 12 and an overload line 10 into an overload region 11.

Figure 3:
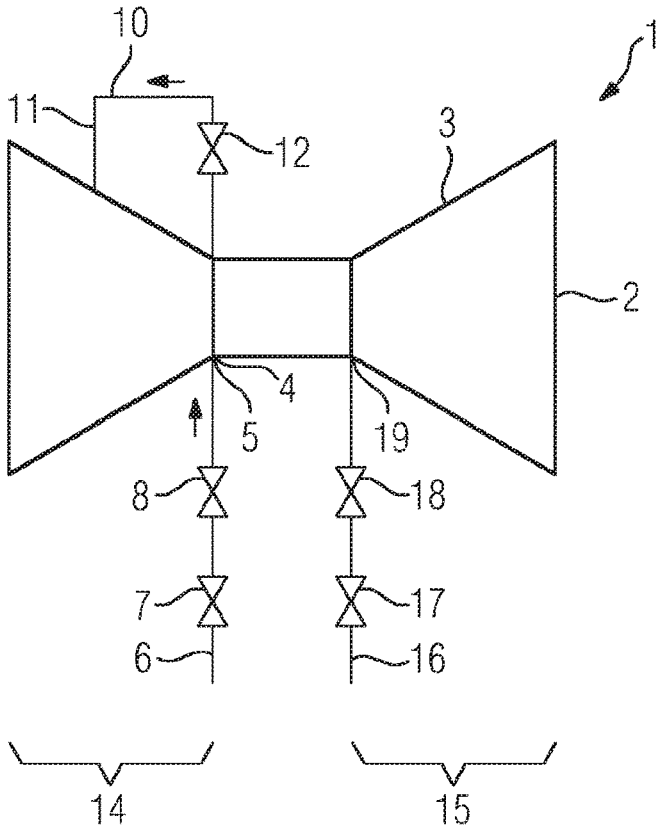
FIG. 3 shows an assembly according to the invention of two-flow configuration.

FIG. 3 shows an extended embodiment of the assembly according to FIG. 2. In the assembly according to FIG. 3, an overload steam is likewise channeled via the overload line 10 into an overload inflow region 11. The difference between the assembly according to FIG. 3 and the embodiment according to FIG. 2 is that the steam turbine 2 is embodied as a two-flow steam turbine with a first flow channel 14 and a second flow channel 15. A fresh steam flows via the fresh-steam line 6 into the first flow channel 14 and from there from the steam turbine 2 to an intermediate superheater (not shown). Steam then flows via a medium-pressure steam line 16 and a medium-pressure quick-closing valve 17 and medium-pressure control valve 18 into a medium-pressure inflow region 19. Steam then flows in the second flow channel 15 through a flow duct out of the steam turbine 2. The thermal energy of the steam is here converted into mechanical energy of the rotor.

Figure 4:
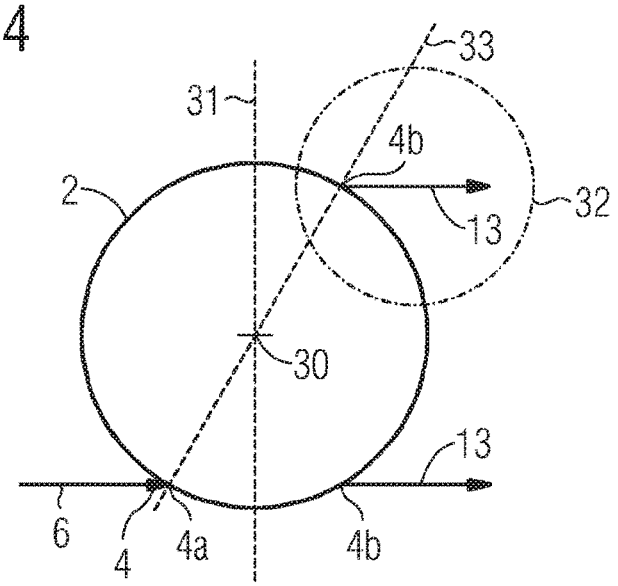
FIG. 4 shows a schematic side view.

FIG. 4 shows a schematic side view of the inflow. Essentially, the steam turbine 2 is formed symmetrically to a vertical axis of symmetry 31 which passes through an axis of rotation 30. A rotor (not shown in FIG. 4) is rotatably mounted in an rotationally symmetrical manner about the axis of rotation. With respect to the axis of symmetry 31, the second connection opening 4*b* and discharge line 13 are arranged mirror-symmetrically oppositely to the connection opening 4*a*. A second variant of how the second connection opening 4*b* can be arranged oppositely is illustrated in FIG. 4 by the dashed line 32. Here, the second connection opening 4*b* is arranged oppositely on an imaginary line 33 which passes through the connection opening 4*a* and axis of rotation 30. The second connection opening 4*b* also lies on the imaginary line 33 here.

Although the invention has been described and illustrated in more detail by way of the preferred exemplary embodiment, the invention is not limited by the disclosed examples and other variations can be derived herefrom by a person skilled in the art without departing from the scope of protection of the invention.

The invention claimed is:

1. An assembly comprising:

a steam turbine with a two-shell casing which comprises an outer casing and an inner casing arranged therein, and a connection guided through the outer casing, wherein the connection comprises a first connection opening and a second connection opening which are formed on the inner casing, further comprising a first valve for feeding steam into the inner casing, wherein the first valve is fluidically connected to the first connection opening, further comprising a second valve for discharging steam, wherein the second valve is fluidically connected to the second connection opening, wherein the steam turbine further has an overload inflow region which is fluidically connected to the second valve, wherein the steam turbine has a blading region which is configured for a flow direction, and the overload inflow region opens into the blading region at a location downstream of a blade stage in the flow direction, wherein the first and second connection openings are formed oppositely on the inner casing.

2. The assembly as claimed in claim 1, wherein the steam turbine is of two-flow configuration, formed by a first flow channel and a second flow channel.

3. The assembly as claimed in claim 2, wherein the first and second valves are arranged on the first flow channel.

4. A method for operating a steam turbine with a two-shell casing including an outer casing and an inner casing arranged therein in overload operation, the method comprising:

operating the steam turbine such that steam flows into an inflow region of the steam turbine via a first valve and a first connection opening, and the steam then flows partially into a blading region and partially out of the steam turbine via a second valve in an overload line and from the overload line flows into an overload inflow region of the steam turbine via a second connection opening, wherein the blading region is configured for a flow direction, and the overload inflow region opens into the blading region at a location downstream of a blade stage in the flow direction, wherein the first and second connection openings are formed oppositely on the inner casing.

5. The method as claimed in claim 4, wherein the second valve is closed in normal operation.

6. The method as claimed in claim 4, wherein the first valve is arranged oppositely to the second valve.

7. The method as claimed in claim 4, wherein the steam turbine is formed with a first and a second flow channel.

* * * * *